US009254990B2

(12) United States Patent
Matthews et al.

(10) Patent No.: US 9,254,990 B2
(45) Date of Patent: Feb. 9, 2016

(54) MULTI-LINK AUTOMOTIVE ALIGNMENT LIFT

(75) Inventors: Jason E. Matthews, Madison, IN (US); Douglas J. Brown, Campbellsburg, IN (US); Gerald D. Bowers, Hanover, IN (US); Brian E. Kelley, Madison, IN (US); Roger A. Ward, Madison, IN (US); Keith W. Siddall, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 1129 days.

(21) Appl. No.: 13/290,270

(22) Filed: Nov. 7, 2011

(65) Prior Publication Data

US 2012/0048653 A1 Mar. 1, 2012

Related U.S. Application Data

(63) Continuation of application No. PCT/US2010/032647, filed on Apr. 28, 2010.

(60) Provisional application No. 61/176,357, filed on May 7, 2009.

(51) Int. Cl.
*B66F 7/08* (2006.01)
*B66F 7/06* (2006.01)

(52) U.S. Cl.
CPC ..... *B66F 7/08* (2013.01); *B66F 7/0691* (2013.01)

(58) Field of Classification Search
CPC ..... B66F 1/025; B66F 1/08; B66F 3/245; B66F 3/30; B66F 7/06; B66F 7/0641; B66F 7/065; B66F 7/0658; B66F 7/0691; B66F 7/08
USPC . 254/10 B, 10 C, 10 R, 2 B, 2 C, 89 H, 89 R, 254/90, 9 B, 9 C; 287/208, 211, 216
See application file for complete search history.

(56) References Cited

U.S. PATENT DOCUMENTS 3,991,857 A * 11/1976 Wolk et al. ..... 187/269
4,534,544 A * 8/1985 Heide ..... 254/9 C (Continued)

FOREIGN PATENT DOCUMENTS

DE 2 231 488 1/1974
WO WO 2007/148960 12/2007

OTHER PUBLICATIONS

International Search Report dated Jun. 28, 2010 for Application No. PCT/US2010/032647.

(Continued)

*Primary Examiner* — Lee D Wilson
*Assistant Examiner* — Jamal Daniel
(74) *Attorney, Agent, or Firm* — Frost Brown Todd LLC

(57) ABSTRACT

An automotive lift comprises a pair of runway sections. Each runway section comprises a deck portion, two pairs of legs, and a pair of elongate sliding members. The pairs of legs are pivotally coupled with the deck portion. The elongate sliding members are pivotally coupled with the pairs of legs and are slidable relative to the deck portion. A hydraulic cylinder assembly is coupled with the deck portion by a clevis and with the elongate sliding members by a piston and piston block. The hydraulic cylinder assembly is operable to translate the elongate sliding members relative to the deck portion, thereby pivoting the pairs of legs relative to the deck portion to lift the deck portion relative to the ground. A hydraulic system is operable to synchronize lifting of the runway sections. A braking mechanism is configured to restrict descent of the runway sections.

20 Claims, 8 Drawing Sheets

(56) References Cited

U.S. PATENT DOCUMENTS

| | | | | |
|---|---|---|---|---|
| 4,724,930 | A * | 2/1988 | VanLierop | 187/204 |
| 4,848,732 | A * | 7/1989 | Rossato | 254/90 |
| 4,901,980 | A * | 2/1990 | Hansen | 254/9 C |
| 5,012,898 | A * | 5/1991 | Tsymberov | 187/208 |
| 5,031,726 | A * | 7/1991 | Wakamiya | 187/204 |
| 5,050,844 | A * | 9/1991 | Hawk | 254/89 H |
| 5,096,159 | A * | 3/1992 | Fletcher | 254/90 |
| 5,099,956 | A * | 3/1992 | Curran | 187/203 |
| 5,190,122 | A * | 3/1993 | Fletcher et al. | 187/207 |
| 5,199,686 | A * | 4/1993 | Fletcher | 187/211 |
| 5,695,173 | A * | 12/1997 | Ochoa et al. | 254/122 |
| 5,727,655 | A * | 3/1998 | Pitman | 187/211 |
| 6,050,573 | A * | 4/2000 | Kunz | 280/6.153 |
| 6,059,263 | A * | 5/2000 | Otema et al. | 254/89 H |
| 6,213,451 | B1 * | 4/2001 | Finkbeiner | 254/124 |
| 6,443,429 | B1 * | 9/2002 | Hawk et al. | 254/90 |
| 6,679,479 | B1 * | 1/2004 | Watkins | 254/9 C |
| 6,918,576 | B2 * | 7/2005 | Finkbeiner | 254/90 |
| 7,066,448 | B2 * | 6/2006 | Thurm | 254/9 C |
| 7,213,686 | B2 * | 5/2007 | Kaufman | 187/262 |
| 7,225,898 | B2 * | 6/2007 | Bourgeois | 187/200 |
| 7,275,713 | B2 * | 10/2007 | Hillsamer et al. | 244/50 |
| 8,052,122 | B2 * | 11/2011 | Rossato et al. | 254/124 |
| 8,286,944 | B2 * | 10/2012 | Rossato et al. | 254/122 |
| 8,496,090 | B2 * | 7/2013 | Berends | 187/204 |
| 8,752,675 | B2 * | 6/2014 | Berends | 187/211 |
| 8,888,070 | B2 * | 11/2014 | Olesen | 254/9 C |
| 2003/0066334 | A1 * | 4/2003 | McClellan | 72/705 |
| 2003/0075657 | A1 * | 4/2003 | Joubert | 248/277.1 |
| 2003/0189194 | A1 * | 10/2003 | Latvys | 254/9 C |
| 2004/0000664 | A1 * | 1/2004 | Watkins | 254/9 C |
| 2004/0200258 | A1 * | 10/2004 | Hess | 72/705 |
| 2004/0262490 | A1 * | 12/2004 | King, Jr. | 248/648 |
| 2009/0205907 | A1 * | 8/2009 | Berends | 187/204 |
| 2010/0243973 | A1 * | 9/2010 | Deuring et al. | 254/122 |
| 2011/0278517 | A1 * | 11/2011 | Deuring et al. | 254/122 |
| 2011/0309316 | A1 * | 12/2011 | Kim | 254/89 H |
| 2012/0298941 | A1 * | 11/2012 | Finkbeiner et al. | 254/93 R |
| 2013/0270040 | A1 * | 10/2013 | Berends | 187/211 |
| 2014/0137328 | A1 * | 5/2014 | Ohta et al. | 5/611 |

OTHER PUBLICATIONS

Written Opinion dated Jun. 28, 2010 for Application No. PCT/US2010/032647.

* cited by examiner

MULTI-LINK AUTOMOTIVE ALIGNMENT LIFT

PRIORITY

This application is a continuation of PCT App. No. PCT/US10/32647, entitled "Multi-Link Automotive Alignment Lift," filed Apr. 28, 2010, which claims the benefit of U.S. Provisional Application No. 61/176,357, entitled "Multi-link Automotive Lift," filed May 7, 2009, the disclosures of which are incorporated by reference herein.

BACKGROUND

A variety of automotive lift systems have been made and used over the years in a variety of contexts. Some types of automotive lifts are installed in-ground while other types are installed above-ground. One type of above-ground automotive lift is known as a parallelogram lift in which the supporting platform, such as a pair of deck rails aligned with the vehicle's wheels, is raised on sets of legs that pivot in relation to the deck rails. By increasing the angular relation between the deck rails and the legs of the lift, the deck rails can be maintained relatively level while being raised to the desired height. This may eliminate the central post or scissor linkages that may exist in other types of lift systems, allowing service personnel unobstructed access to the underside of the vehicle.

Examples of automotive lifts are disclosed in U.S. Pat. No. 5,096,159, entitled "Automotive Lift System," issued Mar. 17, 1992, the disclosure of which is incorporated by reference herein; U.S. Pat. No. 6,059,263, entitled "Automotive Alignment Lift," issued May 9, 2000, the disclosure of which is incorporated by reference herein; U.S. Pat. No. 6,213,451, entitled "Lifting Apparatus," issued Apr. 10, 2001, the disclosure of which is incorporated by reference herein; and International Pub. No. WO 2007/148960, entitled "Vehicle Elevator and Lift Therein," published Dec. 27, 2007, the disclosure of which is incorporated by reference herein.

While a variety of automotive lift systems have been made and used, it is believed that no one prior to the inventors has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
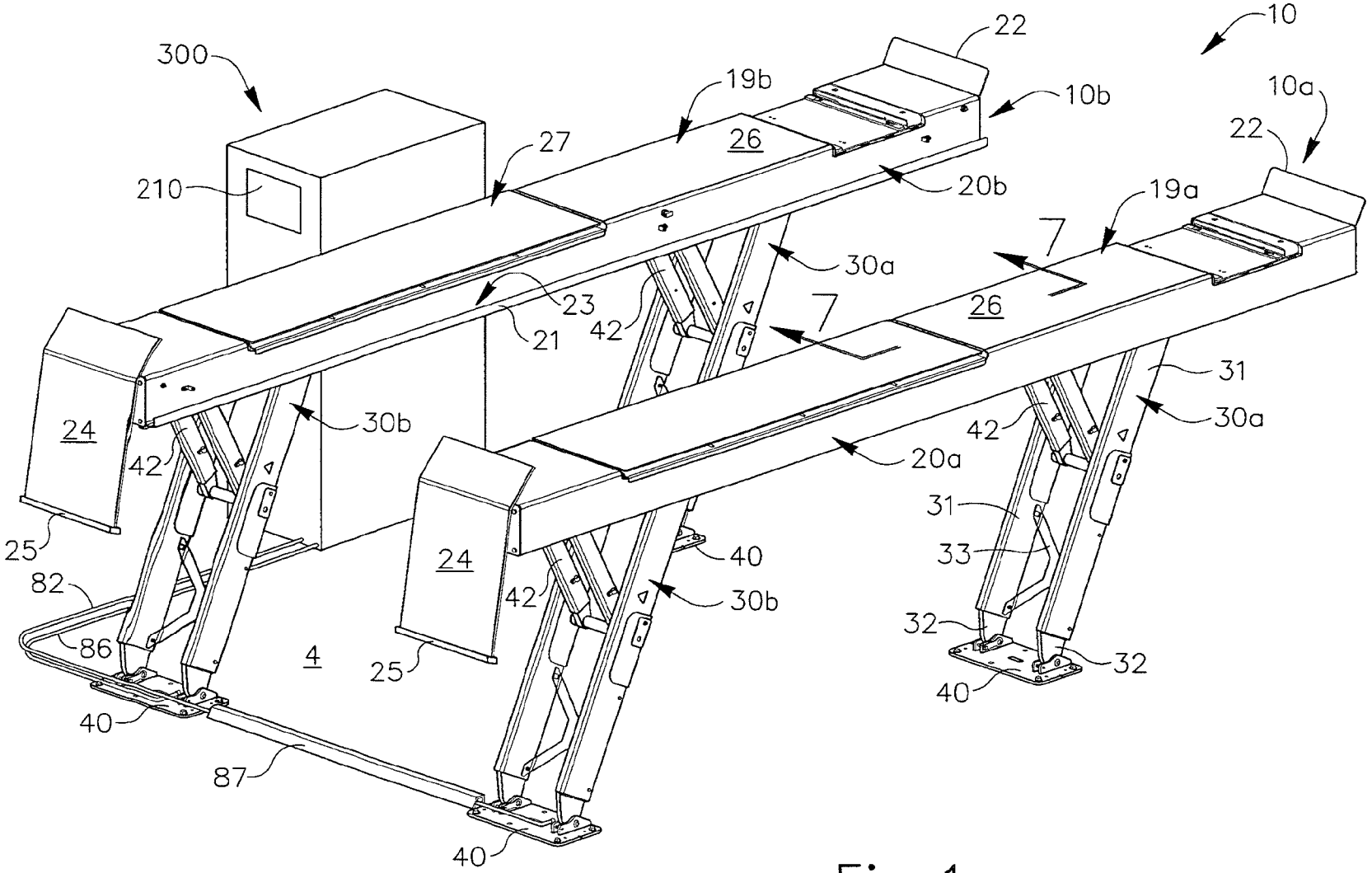
FIG. 1 depicts a perspective view of an exemplary automotive lift system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Exemplary Lift Actuation System

Figure 2:
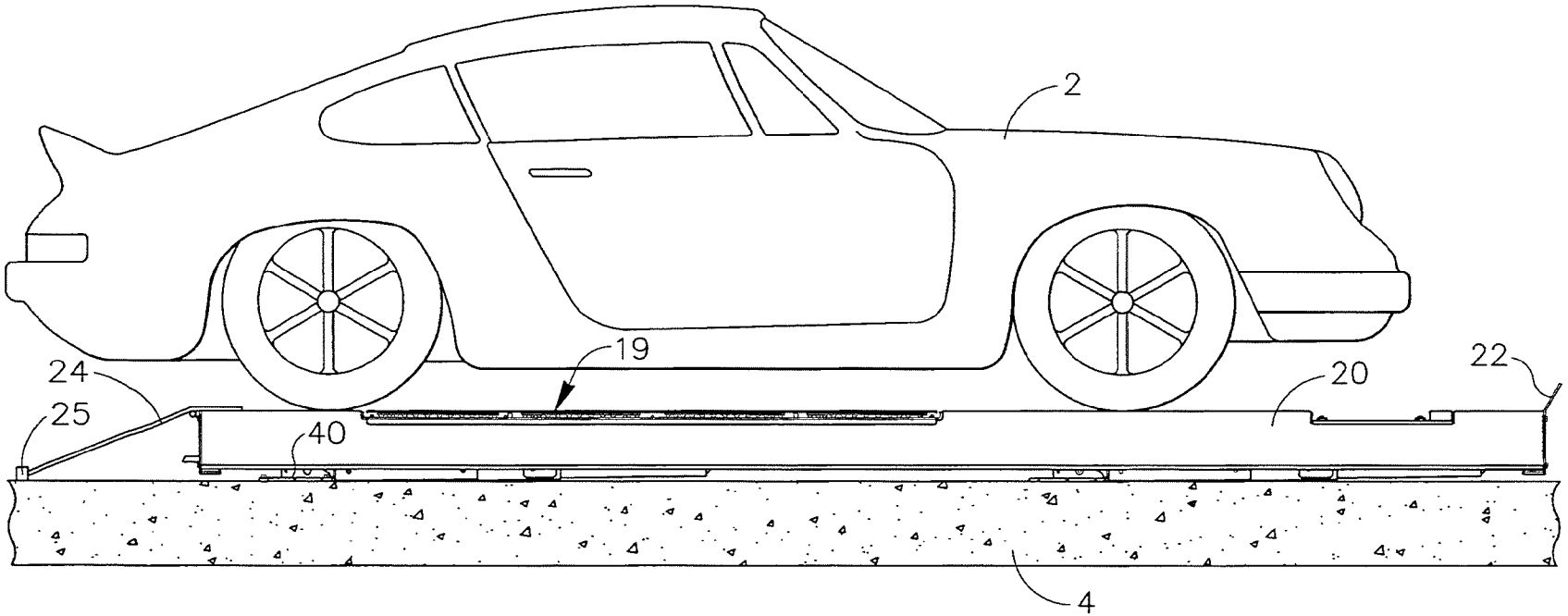
FIG. 2 depicts a side elevational view of the lift system of FIG. 1, showing the lift in a lowered position.
Figure 3:
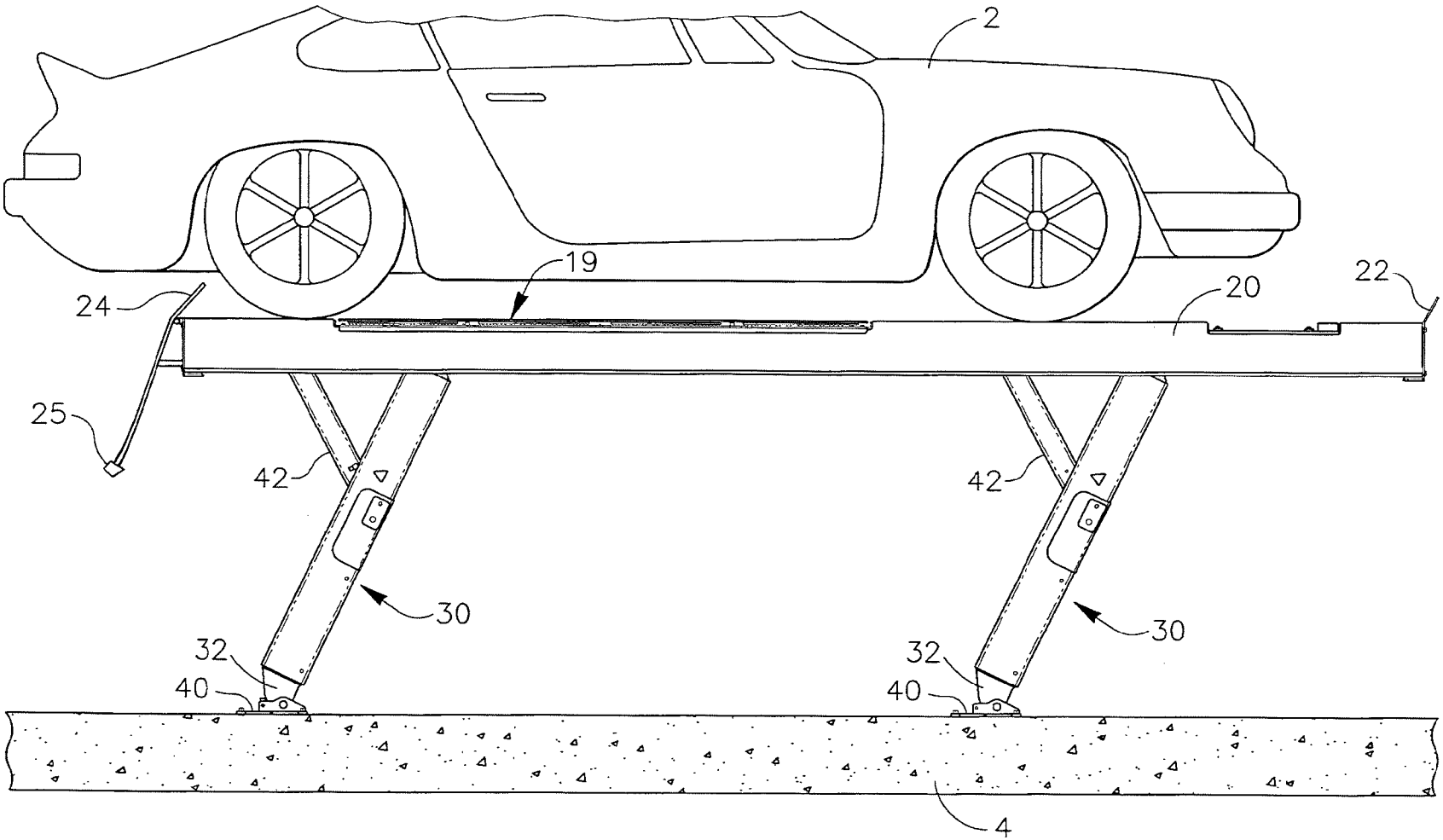
FIG. 3 depicts a side elevational view of the lift system of FIG. 1, showing the lift in a raised position.

FIGS. 1-3 illustrate an exemplary lift (10). Lift (10) of the present example comprises a pair of lift sections (10*a*, 10*b*) that are respectively provided with runway decks (19*a* and 19*b*) which, when installed, are substantially parallel and are spaced apart a distance approximating the distance between the wheels of an automotive vehicle (2). Lift (10) also includes a hydraulic system (300), which is operable to selectively raise and lower runway decks (19*a* and 19*b*) relative to the ground or floor (4) as will be described in greater detail below. The width and length of each runway deck (19) is sufficient to accommodate the thickness of the vehicle's tires and varying wheelbase lengths of different vehicles (2), with sufficient clearance between runway decks (19) to permit servicing and repairs to the underside of the vehicle (2). Runway decks (19) of the present example are respectively provided with a fixed front barrier plate (22) to ensure that a vehicle is properly restrained on the runway decks (19); and a pivoting rear plate (24) which, when lift (10) is in the lowered position shown in FIG. 2, forms a ramp between the floor (26) of runway deck (19) and the floor (4) of the service bay, which allows the vehicle (2) to be driven on and off of lift (10). However, as with other components described herein, plates (22, 24) are merely optional.

The structure of lift (10) will hereinafter be described in relation to one runway deck (19) (identified as 19*a* in FIG. 1) and the lifting and braking mechanisms associated therewith, it being appreciated that the structure of the other runway deck (19) (19*b* in FIG. 1) is substantially identical in the present example. All of the lift components described below may be formed from hardened steel or another suitably rigid and structurally sturdy material, or any other suitable material(s) having any suitable properties.

Figure 4:
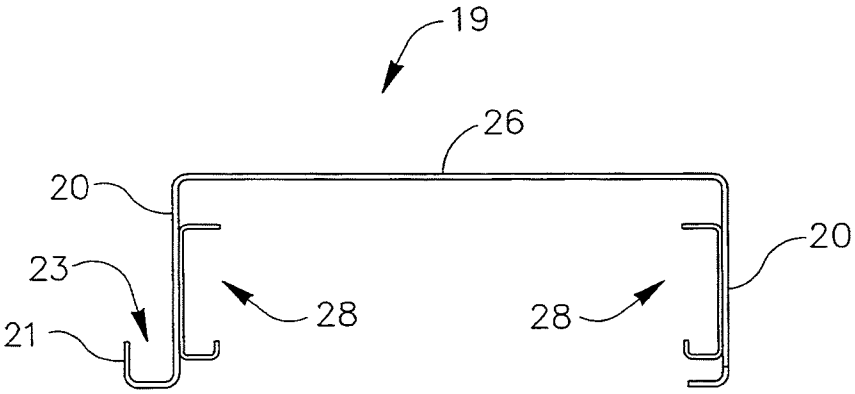
FIG. 4 shows a cross-sectional view of a deck of the lift system of FIG. 1.
Figure 5:
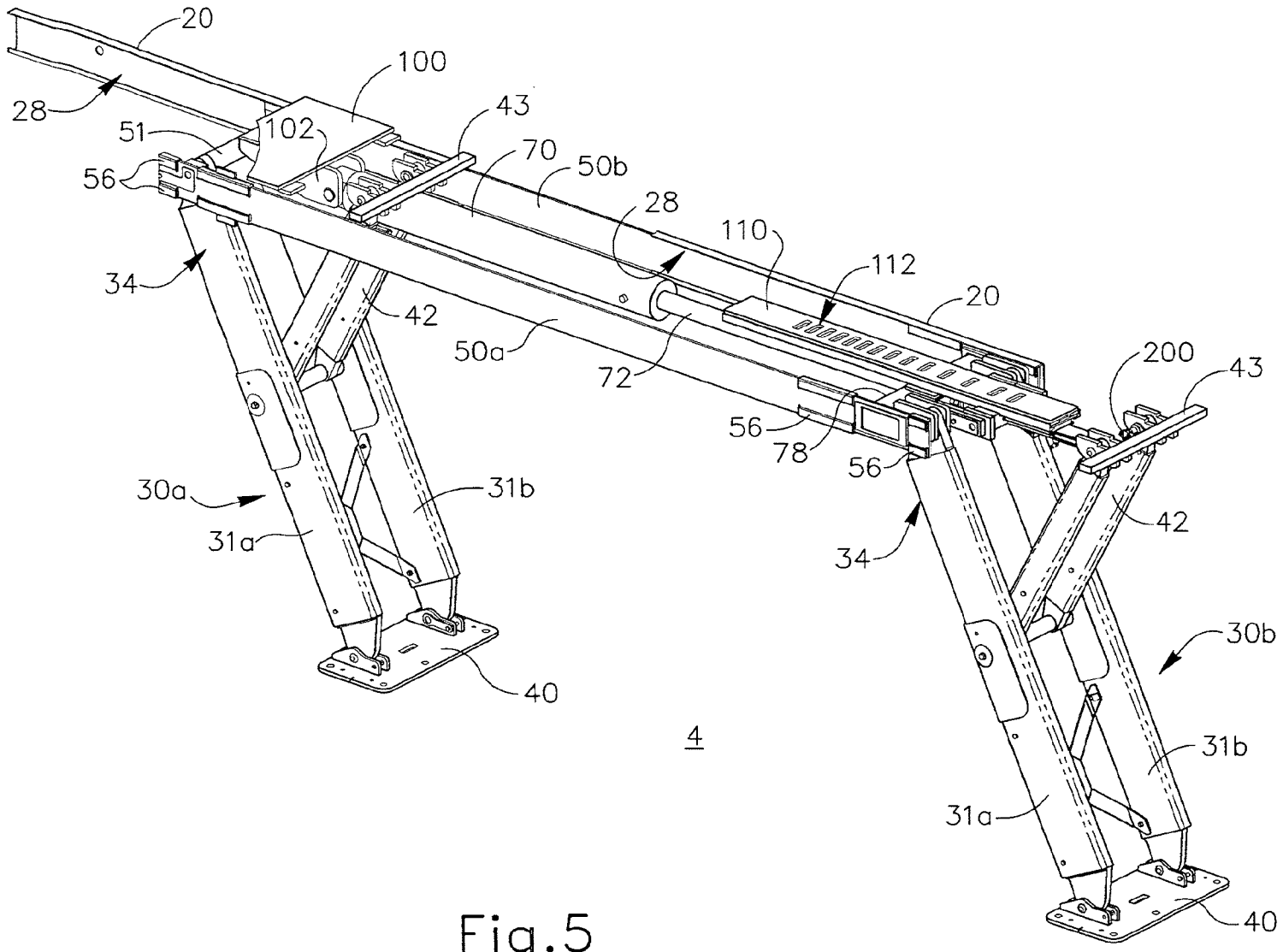
FIG. 5 shows a perspective view of a lifting mechanism of the lift system of FIG. 1.

As shown in FIG. 4, runway deck (19) comprises a floor (26) and two deck rails (20) extending downwardly relative to the outer edges of floor (26). Each deck rail (20) defines a corresponding channel (28) at the interior of its sidewall. Runway deck (19) is supported by lifting legs (30) near the front and near the rear of runway deck (19). Each lifting leg (30) comprises a pair of rigid supporting members (31) in the present example, though any other suitable components or configurations may be used. As shown in FIGS. 1, 3, and 5, the lower ends (32) of each pair of supporting members (31)

are pivotally secured to floor anchor plates (40), which are bolted to the floor (4) of the service bay in conventional fashion. Lifting legs (30*a*) near the front of runway deck (19) are pivotally secured at their upper ends (34) to a pair of sliding bodies (50) by a corresponding axle (51). As also shown in FIG. 4, one deck rail (20) of each runway deck (19) includes an upturned portion (21) that defines a channel (23). Each channel (23) is used to support a "wheels free" device (not shown), which has wheels on each end that roll inside channel (23). As one of ordinary skill in the art will appreciate, such a "wheels free" device may be configured to allow lift (10) to engage a vehicle with the wheels of the vehicle removed. In the present example, only the inner deck rail (20) of each runway deck (19) has upturned portion (21) and channel (23). In some other versions, the outer deck rail (20) of each runway deck (19) also has an upturned portion (21) and channel (23). In still other versions, upturned portions (21) and channels (23) are simply omitted altogether.

Figure 6:
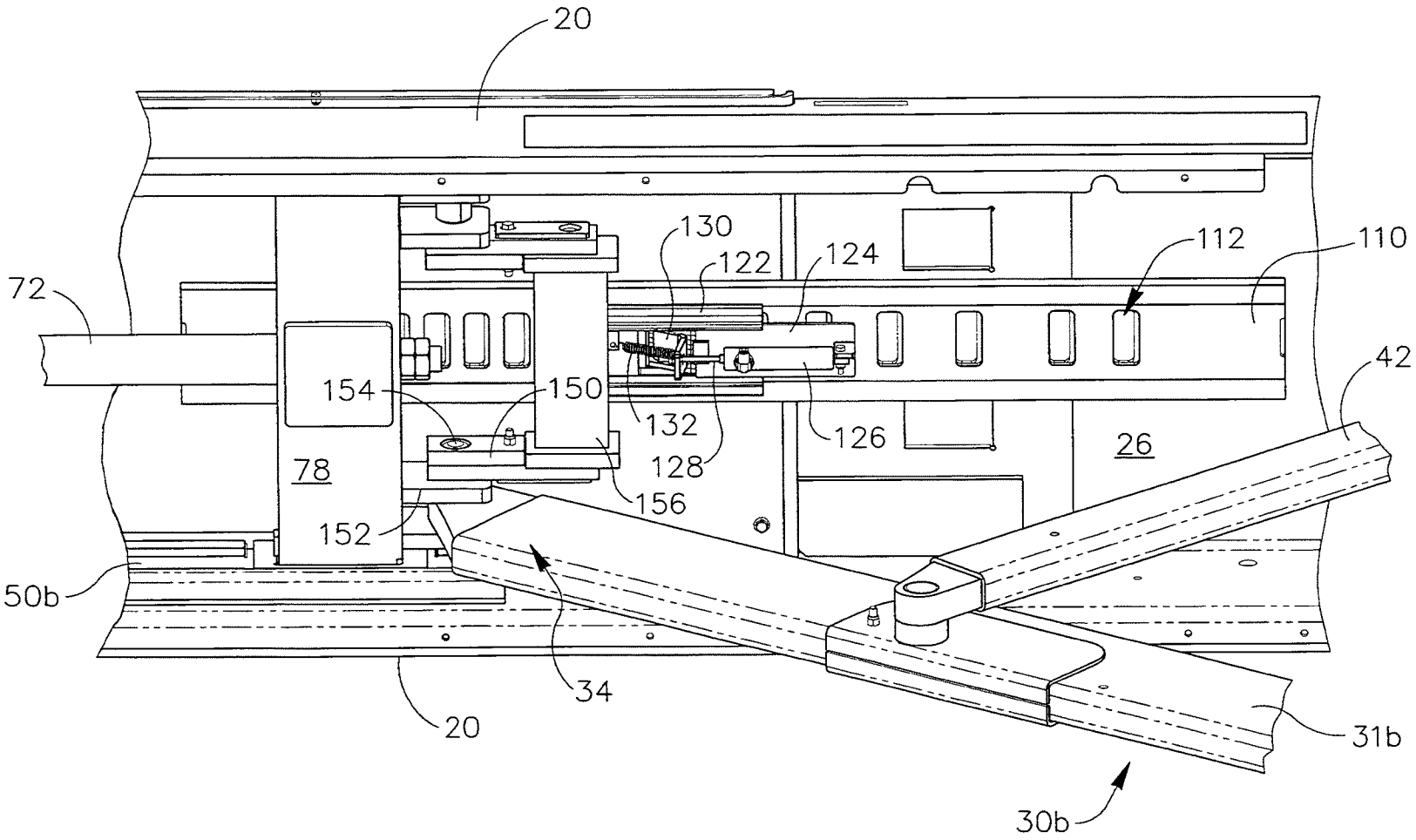
FIG. 6 shows a partial perspective view of the underside of a deck of the lift system of FIG. 1, with a supporting member removed.
Figure 7:
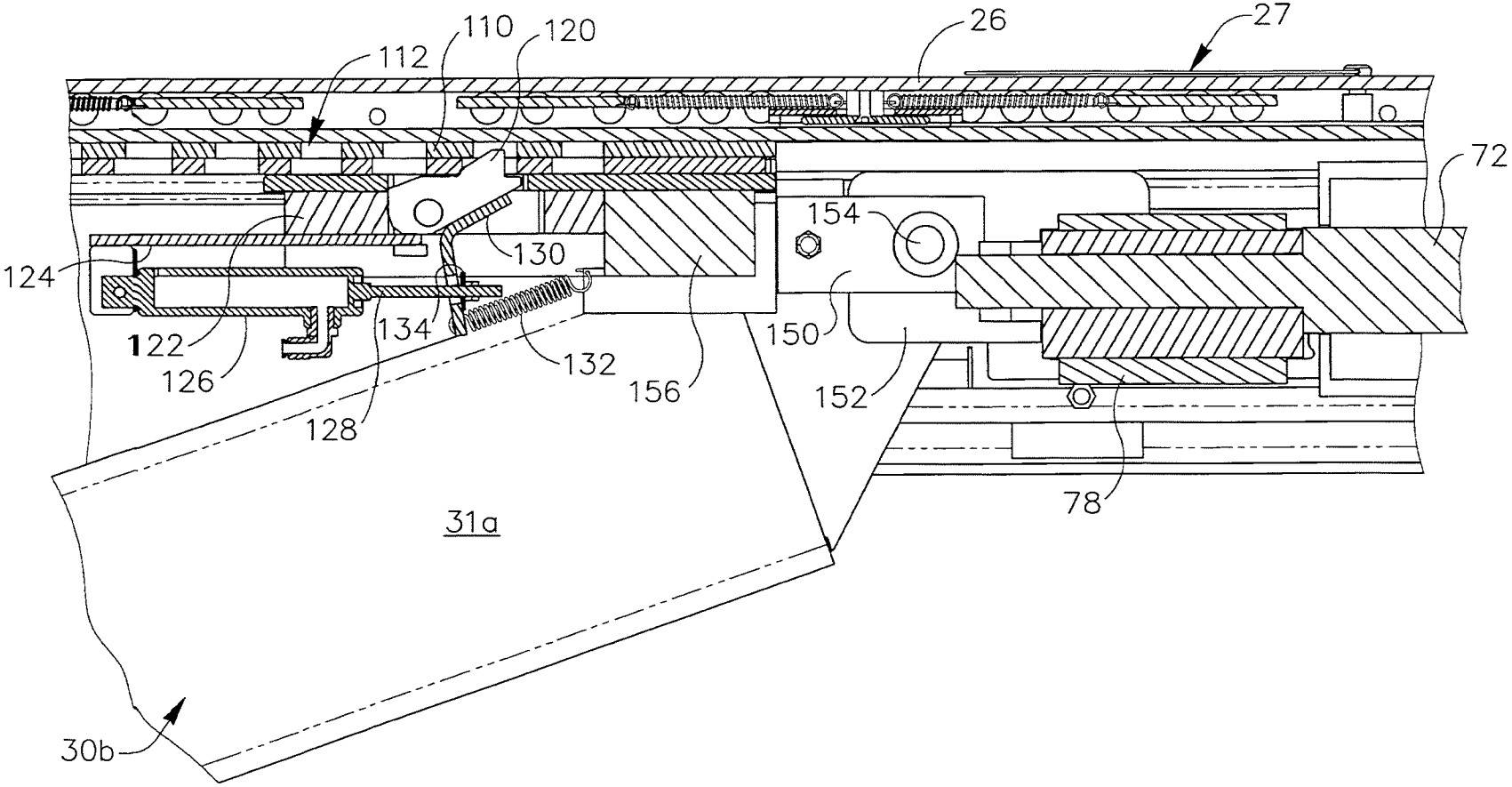
FIG. 7 shows a cross-sectional view of a braking mechanism of the lift system of FIG. 1.

As shown in FIGS. 6-7, lifting legs (30*b*) near the rear end of runway deck (19) are pivotally secured to a pair of brackets (150, 152) by a corresponding pair of axles (154)—with one axle (154) and one pair of brackets (150, 152) for each supporting member (31) of rear lifting legs (30*b*). A block (156) is secured to both brackets (150) that are associated with lifting legs (30*b*). Each bracket (150) is secured to a corresponding bracket (152); while both brackets (152) are secured to piston block (78), which will be described in greater detail below. Piston block (78) thus couples lifting legs (30*b*) with each other. Furthermore, piston block (78) is secured to both sliding bodies (50), such that lifting legs (30*b*) are pivotally coupled with sliding bodies via brackets (150, 152), axles (154), and piston block (78). Each pair of lifting legs (30*a*, 30*b*) also includes a respective leg reinforcement member (33), which provides increased rigidity to lift (10) and legs (30*a*, 30*b*). Alternatively, any other suitable features, components, configurations, or arrangements may be used.

Lifting legs (30) near the front and near the rear of runway deck (19) are thus both secured to the same pair of sliding bodies (50) in the present example. As described in greater detail below, sliding bodies (50) are engaged into channels (28) formed within deck rail (20), and are configured to slide along at least a portion of the length of deck rail (20). Each runway deck (19) thus has a corresponding pair of sliding bodies (50), with the sliding bodies (50) of each pair being coupled together by axles (51) at the front end of the sliding body (50) pair and by piston block (78) at the rear end of the sliding body pair. Axles (51, 154) are configured to allow the corresponding legs (30) to rotate relative to sliding bodies (50).

As noted above, and as shown in FIG. 5, each sliding body (50) is secured to two supporting members (31)—one supporting member (31) near the front of runway deck (19) and one supporting member (31) near the rear of runway deck (19). Both pairs of supporting members (31) in each lift section (10*a*, 10*b*) thus "share" a corresponding single pair of sliding bodies (50) in the present example. In particular, an outer sliding body (50*a*) is pivotally secured to outer supporting member (31*a*) of front leg (30*a*) and is also pivotally secured to outer supporting member (31*a*) of rear leg (30*b*). Inner sliding body (50*b*) is pivotally secured to inner supporting member (31*b*) of front leg (30*a*) and is also pivotally secured to inner supporting member (31*b*) of rear leg (30*b*). Each sliding body (50) further comprises two sets of low-friction slide blocks (56), which are located near the engagement position of sliding body (50) and legs (30). Slide blocks (56) of the present example allow sliding bodies (50) to slide relatively freely within their respective channels (28), so that each sliding body (50) can move along a path of travel defined by a portion of the length of deck rail (20). It should be understood that a variety of alternative features or components may be used in addition to or in lieu of slide blocks (56). As will be described in greater detail below, the sliding action of sliding bodies (50) relative to deck rails (20) provides lifting of runway decks (19), and therefore lifting of vehicle (2), in the present example.

It should also be understood that legs (30*a*, 30*b*) and their two associated sliding bodies (50) together form a unitary sliding assembly in the present example. In other words, legs (30*a*, 30*b*) and their two associated sliding bodies (50) slide unitarily relative to their associated runway deck (19), with legs (30*a*, 30*b*) pivoting relative to their two associated sliding bodies (50) during such sliding. While sliding bodies (50) are each formed as one continuous piece in the present example, other suitable configurations may be used. By way of example only, each sliding body (50) may be broken up into two or more components that are unitarily coupled together by a bar or other third component. Other ways in which a unitary sliding assembly may be configured, including alternative components, features, and arrangements, will be apparent to those of ordinary skill in the art in view of the teachings herein.

Each leg (30) is also tied to runway deck (19) by a pair of link arms (42). Each link arm (42) has an upper end pivotally secured to a corresponding link arm mount (43), as shown in FIG. 5. Link arm mounts (43) are welded to the underside of floor (26) in the present example, though any other suitable structures or techniques for securing link arm mounts (43) relative to runway deck (19) may be used. Link arm mounts (43) are each located at a fixed position that is inwardly spaced from the path of travel of the sliding bodies (50). The lower end of each link arm (42) is pivotally secured to an intermediate position on the corresponding leg (30). The angular relation of link arm (42) relative to the upper portion of the corresponding leg (30) decreases in a toggle fashion as the sliding bodies (50) slide rearwardly along deck rail (20). Thus, as the sliding body (50) attached to the top end of each leg (30) slides rearwardly along the underside of runway deck (19), the angular relation of leg (30) relative to the deck rail (20) (and thus relative to the floor (4)) increases, which raises runway deck (19) from the lowered position shown in FIG. 2 to a raised position such as that shown in FIG. 3.

As shown in FIGS. 1 and 7, each lift section (10*a*, 10*b*) of the present example also includes a respective slip plate assembly (27). It should be understood that such slip plate assemblies (27) may allow the rear wheels of a vehicle to slide easily on lift (10), such as when an alignment is being performed on the vehicle. Of course, as with various other components described herein, slip plate assemblies (27) are merely optional.

The configuration of the present example causes runway decks (19) to rise vertically as lift (10) is raised. Optimal leverage may be obtained when link arm (42) is secured to its associated leg (30) at approximately the midpoint of the leg (30). Alternatively, link arm (42) may be secured to any other suitable position along the length of its corresponding leg (30). The length of link arm (42) may be approximately one half of the length of its corresponding leg (30). Alternatively, link arm (42) may have any other suitable length, and such length may bear any suitable relationship with the length of legs (30).

Thus, in the present example, runway deck (19) is raised by applying a force to sliding bodies (50) to force them rearwardly along channels (28) of deck rails (20), decreasing the angulation between link arms (42) and the upper portions of legs (30) and at the same time increasing the angular relation of legs (30) relative to deck rail (20) (and floor (4)). In the present example, this is accomplished by providing a hydraulic actuator comprising a hydraulic cylinder (70) mounted at a fixed position, concealed underneath floor (26) of runway deck (19), laterally between the respective paths of travel of sliding bodies (50). Hydraulic cylinder (70) of the present example comprises a conventional single-end, two stage, single-acting type of hydraulic cylinder. By way of example only, hydraulic cylinder (70) may be configured in accordance with the teachings of U.S. Pat. No. 3,269,275, entitled "Two Stage Hydraulic Cylinder," issued Aug. 30, 1966, the disclosure of which is incorporated by reference herein. Alternatively, any other suitable type of hydraulic cylinder may be used.

A hydraulic mount (100) is rigidly welded to the underside of floor (26) of runway deck (19) in the present example, though any other suitable structures or techniques for securing hydraulic mount (100) relative to runway deck (19) may be used. Hydraulic mount (100) is coupled with hydraulic cylinder (70) via a clevis (102). Clevis (102) may thus provide some degree of rotational freedom for hydraulic cylinder (70) (e.g., about an axis defined by a pin, bolt, or other fastener coupling hydraulic cylinder (70) with clevis (102)). In some settings, a clevis (102) connection between hydraulic cylinder (70) and runway deck (19) may be preferable over a rigid connection. For instance, if runway deck (19) deflects under the load of vehicle (2), the degree of freedom for hydraulic cylinder (70) provided by clevis (102) may keep the load of vehicle (2) from being transferred to hydraulic cylinder (70). Similarly, clevis (102) may reduce premature wear of components of hydraulic cylinder (70) that might otherwise occur when side loads are exerted on hydraulic cylinder (70). It should be understood that a variety of other types of components and techniques may be used to secure hydraulic cylinder (70) relative to runway deck (19), in addition to or in lieu of hydraulic mount (100) and/or clevis (102). Such alternative components or techniques may or may not provide a degree of freedom for hydraulic cylinder (70).

Hydraulic cylinder (70) of the present example drives a piston shaft (72) which projects out of one end of cylinder (70). The free end of piston shaft (72) is affixed to the sliding bodies (50), at piston block (78) that is positioned between sliding bodies (50) near the top ends of supporting members (31) of rear leg (30*b*), as shown in FIGS. 5-7. As noted above, hydraulic cylinder (70) is fixed relative to runway deck (19); while sliding bodies (50) are slidable relative to deck rail (20) (e.g., slidable through channels (28)). Sliding bodies (50) thus slide synchronously along channels (28) in response to movement of piston shaft (72) relative to hydraulic cylinder (70). Given this sliding relationship, as well as the pivoting relationship between link arms (42) and runway deck (19), the pivoting relationships between link arms (42) and legs (30), and the pivoting relationships between legs (30) and sliding bodies (50), runway deck (19) is thus raised and lowered by changing the axial position of piston shaft (72) relative to the hydraulic cylinder (70). To raise runway deck (19), piston shaft (72) is driven rearwardly in the present example, forcing sliding bodies (50) rearwardly. This synchronizes the change in the angulation of both legs (30) relative to the deck rail (20) and ensures that runway deck (19) remains substantially level at all times during lifting and lowering. It should be understood that lift (10) may be alternatively configured such that forward movement (72) of piston shaft causes runway decks (19) to be raised.

Referring back to FIG. 1, lift (10) of the present example further comprises a hydraulic system (300) that is controlled from an operator's station and/or by a controller (210). Hydraulic system (300) may be operable to lift runway decks (19) and a vehicle (2) using hydraulic pressure that is less than approximately 3,500 psi. By way of example only, hydraulic system (300) may be operable to lift runway decks (19) at a hydraulic pressure of approximately 3,250 psi and at a flow rate of approximately 1.8 gallons per minute. Of course, any other suitable pressure levels and/or flow rates may be used, and the pressure level and/or flow rate may vary based on the vertical position of runway decks (19) and/or other factors, as will be described in greater detail below. Furthermore, it should be understood that the pressure level and/or flow rate may vary during normal operation of lift (10). Hydraulic system (300) is coupled to the inlet of hydraulic cylinder (70) of lift section (10*b*) through a corresponding hose (86). Similarly, hydraulic system (300) is coupled to the inlet of hydraulic cylinder (70) of lift section (10*a*) through a corresponding hose (82). An exemplary configuration of hydraulic system (300) will be described in greater detail below, while other suitable configurations of hydraulic system (300) will be apparent to those of ordinary skill in the art in view of the teachings herein. Hoses (82, 86) are fluidly isolated from each other in the present example. Alternatively, any other suitable fluid communication arrangement may be used. Hoses (82, 86) are securely fastened underneath runway decks (19) and along legs (30) and floor (4) in the present example, so as not to obstruct the workspace beneath lift (10). For instance, a guard plate (87) may be positioned over one or both hoses (82, 86), if desired. Alternatively, hoses (82, 86) may be dealt with in any other suitable fashion.

Exemplary Braking System

Lift (10) of the present example further includes an incremental braking mechanism, which selectively locks sliding bodies (50) into position within channels (28) at the desired elevation of runway decks (19). The braking mechanism allows runway decks (19) to be set to virtually any desired elevated position, and provides a means for preventing free-falling of runway decks (19) in the event of hydraulic system failure. In particular, the braking mechanism is configured to bear the load of a vehicle. In the present example, each lift assembly (10*a*, 10*b*) has just one braking mechanism, though it should be understood that any other suitable number of braking mechanisms may be used.

As shown in FIGS. 5-7, the braking mechanism of the present example comprises a brake ground (110), which is welded relative to the underside of floor (26) of runway deck (19) in the present example, though any other suitable structures or techniques for securing brake ground (110) relative to runway deck (19) may be used. Brake ground (110) includes a plurality of discretely formed slots (112), such that brake ground (110) presents a ladder-like configuration. In the present example, slots (112) are not equidistantly spaced along the length of brake ground (110). In particular, slots (112) get progressively closer to each other as they approach the front of brake ground (110); and get progressively further apart as they approach the rear of brake ground (110). Alternatively, slots (112) may be equidistantly spaced along the length of brake ground (110) or may have any other suitable configuration. Furthermore, slots (112) may be substituted or supplemented with any suitable alternative structure, including but not limited to teeth in a rack-like configuration.

The braking mechanism of the present example further comprises a pawl (120), which is configured to selectively engage slots (112) of brake ground (110) to provide selective braking. Pawl (120) is pivotally coupled with a carriage (122), which is secured to and extends rearwardly from block (156). A mounting plate (124) is also secured to carriage (122).

Mounting plate (124) carries a pneumatic cylinder (126) which is configured to selectively extend and retract a pneumatic piston shaft (128). In particular, pneumatic cylinder (126) comprises a pull-type cylinder, such that piston shaft (128) is retracted into pneumatic cylinder (126) when a pressurized medium is communicated to pneumatic cylinder (126). In some other versions, pneumatic cylinder (126) is configured such that piston shaft (128) is drawn into pneumatic cylinder (126) when a vacuum is induced in pneumatic cylinder (126). In still other versions, a solenoid-type electromechanical actuator or hydraulic actuator is used instead of pneumatic cylinder (126). Alternatively, any other suitable type of actuator or similar device may be used.

Piston shaft (128) is coupled with pawl (120) by a bracket (130), which is welded to pawl (120) in the present example. A spring (132) resiliently couples bracket (130) with block (156), and is biased to urge pawl (120) (via bracket (130)) into engagement with slots (112). While a coil spring (132) is used in the present example, it should be understood that any other suitable type of resilient member or other type of structure for biasing pawl (120) may be used. A stop member (134) is secured to piston shaft (128), and is configured to restrict movement of bracket (130) along the length of piston shaft (128). When piston shaft (128) is retracted relative to pneumatic cylinder (126) (e.g., by communicating a pressurized medium to pneumatic cylinder (126)), stop member (134) pulls on bracket (130) to disengage pawl (120) from slot (112), overcoming the resilient bias provided by spring (132). When piston shaft (128) is thereafter extended relative to pneumatic cylinder (126) (e.g., by venting or providing positive pressure to pneumatic cylinder (126)), spring (132) pulls bracket (130) to engage slot (112). Pneumatic communication with pneumatic cylinder may be controlled by controller (210), which is described in greater detail below, or such control may be provided in any other suitable fashion.

It should be understood that during operation of lift (10), with the exception of brake ground (110), the braking mechanism of the present example slides unitarily with sliding bodies (50) and other members of the sliding assembly described above. Such unitary sliding is provided by the coupling of the braking mechanism with sliding bodies (50) via block (156), brackets (150, 154), and piston block (78), which is itself secured to sliding bodies (50). In other words, such unitary sliding is provided by the common coupling of the braking mechanism and sliding assembly with blocks (156, 78) in the present example. With brake ground (110) being fixedly secured to runway deck (19), the rest of the braking mechanism slides relative to brake ground (110) as the braking mechanism slides unitarily with the sliding assembly.

During operation of lift (10), the configuration of pawl (120) and slots (112) may provide substantially little (if any) resistance to the ascent of runway decks (19). In other words, pawl (120) may essentially "ratchet" across brake ground (110) during ascent of runway decks (19). Once the desired height has been reached with runway decks (19), such that the ascent is stopped, pawl (120) may engage a slot (112) of brake ground (110) (under the resilient urging of spring (132)) to substantially lock the vertical position of runway decks (19). To the extent that pawl (120) is positioned somewhere between slots (112) when ascent of runway decks (19) is stopped, the vertical position of runway decks (19) may be further manually or automatically adjusted to engage pawl (120) with one of the adjacent slots (112). Alternatively, controller (210) may be programmed to prevent runway decks (19) from being stopped at a vertical position where pawl (120) would be positioned between slots (112), such that controller (210) will automatically provide a vertical position of runway decks (19) where pawl (120) will be engaged with a slot (112). As yet another alternative, lift (10) may permit runway decks (19) to be raised to and stopped at a vertical position where pawl (120) is positioned between slots (112), with pawl (120) being engaged in a slot (112) only in the event that a runway deck (19) suddenly drops, such as in the case of sudden hydraulic failure. Still other suitable ways in which the braking system may be operated during ascent of runway decks (19) and/or after ascent of runway decks (19) has stopped will be apparent to those of ordinary skill in the art in view of the teachings herein.

When raised runway decks (19) are to be lowered, pneumatic cylinder (126) may be actuated to retract piston shaft (128) to thereby disengage pawl (120) from slot (112), overcoming the resilient bias provided by spring (132). In some versions, decks (19) are raised slightly just before their descent, to facilitate disengagement of pawl (120) from slot (112) by providing clearance. With pawl (120) disengaged from slot (112), runway decks (19) may be lowered as described elsewhere herein. Pawl (120) may remain disengaged from slots (112) during the descent of runway decks (19), due to operation of pneumatic cylinder (126). In some versions, controller (210) is programmed to automatically operate pneumatic cylinder (126) to disengage pawl (120) from slot (112) upon receiving a command from a user to lower runway decks (19). In some other versions, a separate user input is used to manually operate pneumatic cylinder (126) to disengage pawl (120) from slot (112) when descent of runway decks (19) is desired. Alternatively, the braking mechanism may be operated in any other suitable fashion during descent of runway decks (19).

It should be understood that the braking mechanism of the present example may permit hydraulic cylinder (70) to be removed without requiring external support for runway deck (19). This is because, in the present example, hydraulic cylinders (70) are not used to support the weight of runway decks (19) and a vehicle (2). Each hydraulic cylinder (70) is merely used to move sliding bodies (50) along channels (28); whereas the braking mechanism is used to support the weight of runway decks (19) and a vehicle (2) in the present example. Of course, hydraulic cylinder (70) and piston shaft (72) may hydraulically bear the weight of runway deck (19) and a vehicle (2) as deck (19) is being raised, before the braking mechanism is engaged. However, once the braking mechanism is engaged in the present example, the braking mechanism bears the weight of runway deck (19) and a vehicle (2). Of course, the braking mechanism may be varied, modified, substituted, and/or supplemented in a variety of ways. Alternatively, the braking mechanism may be omitted altogether, if desired.

Exemplary Hydraulic System and Deck Synchronization

Figure 8:
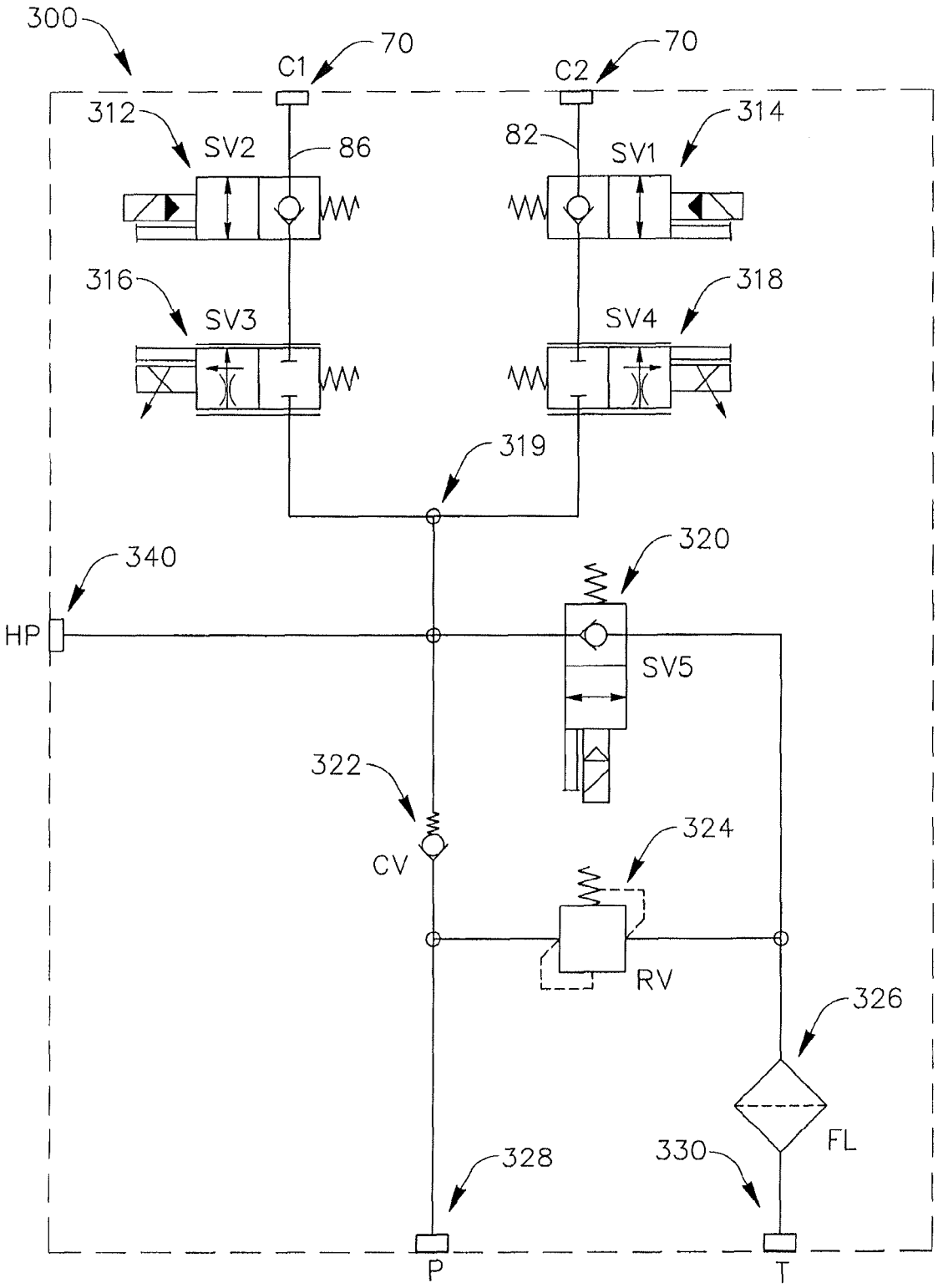
FIG. 8 shows a schematic view of an exemplary hydraulic circuit of the lift system of FIG. 1.

As noted above and as shown in FIG. 1, lift (10) is actuated by a hydraulic system (300), which is controlled by controller (210). FIG. 8 shows exemplary components of hydraulic system (300). In particular, hydraulic system (300) of the present example includes a pair of blocking valves (312, 314), a pair of proportional valves (316, 318), a main lowering blocking valve (320), a check valve (322), a relief valve (324), a fluid filter (326), a pump (328), and a reservoir tank (330). Blocking valves (312, 314) and main blocking valve (320) are biased to assume a closed position. However, controller (210) is operable to selectively open blocking valves (312, 314) and main blocking valve (320). Proportional valves (316, 318) are also biased to assume a closed position, while controller (210) is operable to selectively open proportional valves (316, 318) to any selected degree. In the present example, proportional valves (316, 318) are infinitely adjustable between the fully closed position and the fully open position. Controller (210) is also operable to selectively activate pump (328). In the present example, pump (328) comprises a variable displacement piston pump, which is operable to vary fluid flow from between approximately zero gallons per minute to approximately 7.5 gallons per minute. It should be understood that the pressure required from pump (328) may decrease as lift (10) raises, due to mechanical advantages provided by link arms (42), etc. For instance, the fluid pressure provided by pump (328) may initially be at approximately 3,250 psi when runway decks (19) are at their lowest position at the initiation of ascent; then at approximately 200 psi when runway decks (19) reach the fully raised position. Alternatively, hydraulic system (300) may operate within any other suitable pressure range. It should also be understood that a variable displacement piston pump is merely one example, that any other suitable type of pump may be used, and that any other suitable flow rate and/or flow rate range may be used.

In the present example, blocking valve (312) is coupled with hose (86), which is in turn coupled with cylinder (70) of lift section (10*b*). Blocking valve (314) is coupled with hose (82), which is in turn coupled with cylinder (70) of lift section (10*a*). Hydraulic system (300) of the present example also includes a hand pump port (340), which is configured to couple with a hand pump. In particular, a hand pump may be coupled with hydraulic system (300) via hand pump port (340) during a power outage or under other circumstances to help raise runway decks (19) enough to allow pawl (120) to be disengaged from brake ground (110), allowing decks (19) to then be lowered manually. Of course, a variety of other components or features may be used to provide manual raising of decks (19) to assist in disengaging a braking mechanism. Alternatively, such manual lifting components may be omitted if desired.

Hydraulic Lift (10) of the present example also includes position sensors (200) that are in communication with controller (210) and that are used to influence how controller (210) controls hydraulic system (300), to substantially synchronize lifting of runway decks (19) as described in greater detail below. Each position sensor (200) of the present example comprises a rotary potentiometer. In particular, and as shown in FIG. 5, a position sensor (200) is secured to the top of each pair of rear link arms (42) and the underside of each corresponding runway deck (19*a*, 19*b*), and is configured to sense the vertical position of each runway deck (19*a*, 19*b*) by sensing the angle defined between each pair of rear link arms (42) and the corresponding runway deck (19*a*, 19*b*). Of course, any other suitable type of position sensor may be used (e.g., optical sensor, proximity sensor, etc.) in any other suitable location. Furthermore, while only one position sensor (200) is secured to each runway deck (19*a*, 19*b*) in the present example, it should be understood that any other suitable number of position sensors (200) may be used in any suitable location(s) relative to lift (10). Position sensors (200) are also in communication with controller (210). Such communication from position sensors (200) to controller (210) may be provided via wire or wirelessly. Controller (210) is configured to process position data communicated from position sensors (200), and is further configured to detect discrepancies in heights of decks (19*a*, 19*b*) and provide appropriate correction. Controller (210) may comprise a variety of types of components in a variety of arrangements. For instance, controller (210) may comprise a processor, a memory, a user input (e.g., "raise" button, "lower" button, etc), and/or various other components and features. Various suitable components, features, and configurations of controller (210) will be apparent to those of ordinary skill in the art in view of the teachings herein.

In an exemplary operation, an operator presses a "raise" button (not shown) to indicate to controller (210) that hydraulic lift (10) should move from a lowered position to a raised position. In response, controller (210) provides electrical power to activate pump (328), opens proportional valves (316, 318), and opens blocking valves (312, 314). Pump (328) thus sends fluid to hoses (82, 86), and thus to hydraulic cylinders (70), through check valve (322), a tee intersection (319), proportional valves (316, 318), and blocking valves (312, 314). Tee passageway (319) enables flow to both hydraulic cylinders from a single pump (328). Blocking valves (312, 314) are fully open as lift (10) is rising.

The amount of fluid directed to each hydraulic cylinder (70) is regulated by controller (210) sending an amount of electrical power to proportional valves (316, 318) to selectively adjust the degree to which either proportional valve (316, 318) is open. For instance, if position sensors (200) indicate that runway deck (19*a*) is lower in height than runway deck (19*b*) during the ascent of runway decks (19*a*, 19*b*), controller (210) opens proportional valve (318) to a greater degree than the degree to which proportional valve (316) is opened, thus causing more flow to enter the cylinder (70) associated with runway deck (19*a*), thereby increasing the ascent speed of runway deck (19*a*) relative to the ascent speed of runway deck (19*b*). In addition or in the alternative, controller (210) may respond to the same height discrepancy by reducing the degree to which proportional valve (316) is open relative to the degree to which proportional valve (318) is opened, thus reducing the flow entering cylinder (70) associated with runway deck (19*b*) to thereby decrease the ascent speed of runway deck (19*b*) relative to the ascent speed of runway deck (19*a*). It should therefore be understood that controller (210) may actively adjust either or both proportional valves (316, 318) to correct discrepancies between the heights of decks (19*a*, 19*b*) as decks (19*a*, 19*b*) ascend from a lowered position to a raised position. In other words, controller (210) may be used to speed up the ascent of a "lagging" runway deck (19*a*) and/or slow down the ascent of a "leading" runway deck (19*a*, 19*b*). It should also be understood that the adjustable control of proportional valves (316, 318) may allow decks (19*a*, 19*b*) to be raised in a substantially synchronized, coordinated, and simultaneous fashion.

Once decks (19*a*, 19*b*) have been raised to a suitable height, the operator may release the "raise" button. It should therefore be understood that the operator must continue to depress the "raise" as decks (19*a*, 19*b*) are being raised in order for the ascent of decks (19*a*, 19*b*) to continue. Alternatively, controller (210) may be configured such that the operator need only tap the "raise" button or press it for a predetermined time period (e.g., three seconds, etc.) in order to for decks (19*a*, 19*b*) to move to a raised height. In some such versions, decks (19*a*, 19*b*) will ascend to a predetermined height in response to such temporary pressing of the "raise" button, and will continue such ascent to the predetermined height even after the "raise" button is released. In the present example, when no button is depressed by the operator (e.g., after decks (19*a*, 19*b*) have reached a desired height or as decks (19*a*, 19*b*) are at a lowered position, etc.), controller (210) does not provide electrical power to pump (328) or any of the valves (312, 314, 316, 318, 320). As noted above, valves (312, 314, 316, 318, 320) are each resiliently biased to assume a fully closed configuration. In addition, check valve (322) is configured to prevent reverse flow back to pump (328). Thus, runways (19*a*, 19*b*) are held at their current position when neither a "raise" button nor a "lower" button is being activated by an operator. While the present example refers to buttons as user inputs, it should be understood that any suitable type of user inputs may be provided.

In another phase of exemplary operation, an operator presses a "lower" button to indicate to controller (210) that hydraulic lift (10) should move from a raised position to a lowered position. In response, controller (210) provides electrical power to blocking valves (312, 314), to proportional valves (316, 318), and to main lowering blocking valve (320) to open them. Fluid flows from hydraulic cylinders (70) through blocking valves (312, 314), through proportional valves (316, 318), through tee passageway (319), through main lowering blocking valve (320), then through filter (326) to ultimately reach reservoir tank (330). Tee passageway (319) enables fluid from each hydraulic cylinder (70) to flow through a single main lowering blocking valve (320) before it reaches reservoir tank (330). Decks (19*a*, 19*b*) lower to the ground or floor (4) as fluid is drained from cylinders (70).

The amount of fluid directed from each hydraulic cylinder (70) during descent of lift (10) is regulated by controller (210) selectively sending electrical power to proportional valves (316, 318) to selectively adjust the degree to which either proportional valve (316, 318) is open. For instance, if position sensors (200) indicate that runway deck (19*a*) is lower in height than runway deck (19*b*) during the descent of runway decks (19*a*, 19*b*), controller (210) restricts proportional valve (318) to a greater degree than the degree to which proportional valve (316) is restricted, thus causing less flow from the cylinder (70) associated with runway deck (19*a*), thereby slowing the descent speed of runway deck (19*a*) relative to the descent speed of runway deck (19*b*). In addition or in the alternative, controller (210) may respond to the same height discrepancy by opening proportional valve (316) to a greater degree than the degree to which proportional valve (318) is opened, thus increasing the flow from cylinder (70) associated with runway deck (19*b*) to thereby increase the descent speed of runway deck (19*b*) relative to the descent speed of runway deck (19*a*). It should therefore be understood that controller (210) may actively adjust either or both proportional valves (316, 318) to correct discrepancies between the heights of decks (19*a*, 19*b*) as decks (19*a*, 19*b*) descent from a raised position to a lowered position. In other words, controller (210) may be used to speed up the descent of a "lagging" runway deck (19*a*) and/or slow down the descent of a "leading" runway deck (19*a*, 19*b*). It should also be understood that the adjustable control of proportional valves (316, 318) may allow decks (19*a*, 19*b*) to be lowered in a substantially synchronized, coordinated, and simultaneous fashion.

In the present example, the openings in proportional valves (316, 318) are also varied to keep the rate of descent more consistent and above a specified threshold throughout the lowering range of travel of decks (19*a*, 19*b*). In some versions, this keeps lift system (10) from increasing in speed and crashing down as it reaches the fully lowered position. Hydraulic system (300) may also include a velocity fuse that is between hoses (82, 86) and hydraulic cylinders (70) in case hoses (82, 86) are severed or some other leak occurs. The velocity fuses is configured to automatically close in response to the fluid flow exceeding a predetermined flow rate. In some versions, due to the above-described use of controller (210), performance of lift (10) may be relatively unaffected by leakage of hydraulic fluid. In particular, corrections that can be made by controller (210) may substantially compensate for performance discrepancies that might otherwise occur if there is fluid leakage with respect to one of the lift sections (10*a*, 10*b*).

Of course, the above description of hydraulic system (300) relates to just one of many available options. In some other versions, hydraulic system (300) includes two independently operable hydraulic pumps, each pump being associated with a corresponding lift section (10*a*, 10*b*). Other suitable variations of hydraulic system (300) will be apparent to those of ordinary skill in the art in view of the teachings herein.

In some versions, position sensors (200) are also used to ensure engagement between pawl (120) and a slot (112) of the braking mechanism at the end of the ascent of runway decks (19). For instance, controller (210) may be programmed with discrete vertical heights associated with engagement between pawl (120) and slot (112), and may automatically ensure that the ascent of runway decks (19) is stopped only at one of such discrete vertical heights, using position data communicated from position sensors (200). As one merely illustrative example of operation of lift (10), a user's ascent command may be associated with some other vertical height that is between two of the discrete vertical heights known to controller (210). That is, the user may release an ascent button when runway decks (19) are located at a vertical position where pawl (120) is positioned between slots (112). Using feedback from position sensors (200), controller (210) may detect that this vertical position is between two of the discrete vertical heights known to controller (210), and may automatically further adjust the vertical position of runway decks (19) (e.g., higher or lower) to reach one of the discrete vertical heights known to controller (210), to thereby ensure engagement of pawl (120) with a slot (112). Of course, such use of position sensors (200) and operation of controller (210) is merely optional.

Various components that may be incorporated into controller (210) (e.g., processor, circuit board, etc.) will be apparent to those of ordinary skill in the art in view of the teachings herein. Similarly, other ways in which runway decks (19*a*, 19*b*) may be synchronized will be apparent to those of ordinary skill in the art in view of the teachings herein. It should also be understood that some versions of lift (10) may simply lack such automated synchronization altogether. For instance, controller (210), position sensors (200) and/or proportional valves (316, 318) may be simply omitted, if desired.

Exemplary Installation and Operation

To install lift (10) of the present example, one lift assembly (10*a*) is secured to the service bay floor (4) in a vertical orientation by bolting or otherwise securing anchor plates (40) to the floor (4). The other lift assembly (10*b*) is located so as to be parallel and aligned front-to-rear with lift assembly (10*a*), and spaced therefrom according to the wheelbase length of the vehicles (2) to be serviced on lift (10), and is secured to service bay floor (4) in like fashion. The hydraulic system is installed, care being taken to ensure that hoses (82, 86) are secured away from the workspace beneath lift (10) and will not be crimped or pinched by any of the moving parts of lift (10). Runway decks (19) are set to the lowered position and any entrained air is bled from the hydraulic system. Alternatively, lift (10) may be installed in any other suitable fashion.

In operation, an automotive vehicle (2) is driven up to rear plates (24) and onto runway decks (19), to the position shown in FIG. 2. Runway decks (19) are raised by an operator at the working station by actuating hydraulic pump (328). Hydraulic fluid is thereby pumped into cylinder (70) of each lift section (10*a*, 10*b*), thereby extending piston shaft (72) of each lift section (10*a*, 10*b*) rearwardly. This rearward movement of piston shafts (72) causes sliding bodies (50) to translate rearwardly, which in turn causes runway decks (19) to rise as the angular relation between legs (30) and the runway decks (19)

increases. As runway decks (19) rise off of the floor (4), rear plates (24) pivot to a vertical or oblique position and form a barrier against the vehicle (2) rolling off of the rear of lift (10), as shown in FIG. 3. Controller (210) monitors position data communicated from position sensors (200), and adjusts for any discrepancies between runway decks (19*a*, 19*b*) (e.g., rate of ascent, horizontal levelness, etc.) by controlling proportional valves (316, 318). Controller (210) engages in such monitoring (and correction, if necessary) during ascent of decks (19*a*, 19*b*) in the present example. Pawl (120) of the braking mechanism "ratchets" across slots (112) during ascent, providing no substantial resistance to the ascent in the present example.

To lower runway decks (19), the brake mechanism is disengaged by disengaging pawl (120) from slot (112) as described above, allowing sliding bodies (50) to slide forwardly in channels (28) as hydraulic fluid is drained from cylinders (70). In particular, the hydraulic pressure is reduced in cylinders (70), to allow for a controlled lowering of runway decks (19). The weight of the vehicle (2) causes sliding bodies (50) to slide forwardly along deck rails (20) in synchronous relation as piston shafts (72) are displaced forwardly through and into cylinders (70) with hydraulic pressure being reduced, until lift (10) has reached the lowered position shown in FIG. 2. Controller (210) again monitors position data communicated from position sensors (200), and adjusts for any discrepancies between runway decks (19*a*, 19*b*) (e.g., rate of descent, horizontal levelness, etc.) by controlling proportional valves (316, 318). Controller (210) engages in such monitoring (and correction, if necessary) during descent of decks (19*a*, 19*b*) in the present example.

Optionally, a failsafe switch (not shown) may be activated when lift (10) is being lowered, to automatically stop the lowering process, for example at a height of approximately 18 inches or at any other suitable height. This may provide service personnel an additional opportunity to ensure that the area under lift (10) is clear before lift (10) is completely lowered to floor level. Of course, lift (10) may be operated in any other suitable fashion, whether during ascent of runway decks (19), during descent of runway decks (19), and/or at any other stage of operation.

Automotive lift (10) of the present example may be suitable for standard automotive vehicles. For commercial vehicles, a lift having a higher capacity may be required, in which case a third leg (30) or any other suitable number of legs (30) may be added to each lift section (10*a*, 10*b*). Such additional legs (30) may be coupled with sliding members (50) in a manner similar to that described above, without necessarily introducing any additional hydraulic cylinders (70). Alternatively, one or more additional hydraulic cylinders (70) may be provided, and may be incorporated into lift (10) in any suitable fashion. Still other ways in which various features, components, functionalities, and operability of lift (10) may be varied, modified, substituted, supplemented, added, or omitted will be apparent to those of ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

We claim:

1. An automotive lift, comprising:

(a) a first runway section, wherein the first runway section comprises:

(i) a deck portion, (ii) a first pair of legs, wherein the first pair of legs comprises a first leg and a second leg, (iii) a second pair of legs, wherein the second pair of legs comprises a third leg and a fourth leg, (iv) a first elongate member comprising a first end and a third end, wherein the first end is pivotally coupled with the first leg, and the third end is pivotally coupled to the third leg such that the first elongate member extends from the first leg to the third leg, and (v) a second elongate member pivotally coupled with the second and fourth legs, wherein the first and second elongate members are slidable relative to the deck portion;

(b) a second runway section, wherein the first and second runway sections are operable to engage a vehicle, wherein the first and second runway sections are configured to raise and lower a vehicle relative to the ground; and (c) a hydraulic system operable to selectively raise and lower the first and second runway sections relative to the ground.

2. The automotive lift of claim 1, wherein the hydraulic system comprises a cylinder and a piston shaft, wherein the cylinder is coupled with the deck portion of the first runway section.

3. The automotive lift of claim 2, further comprising a clevis coupling the cylinder relative to the deck portion.

4. The automotive lift of claim 3, wherein the clevis is configured to permit the cylinder to rotate relative to the deck portion.

5. The automotive lift of claim 2, further comprising a piston block coupled with the first and second elongate members, wherein the piston shaft is coupled with the piston block, such that the piston shaft is operable to translate the first and second elongate members relative to the deck portion upon translation of the piston shaft relative to the cylinder.

6. The automotive lift of claim 2, wherein the cylinder has a first end and a second end, wherein the piston shaft slidably extends from the first end, wherein the second end is closed.

7. The automotive lift of claim 1, wherein the deck portion comprises a floor and a pair of deck rails extending downwardly from the floor.

8. The automotive lift of claim 7, wherein the deck rails define a first channel and a second channel, wherein the first elongate member is slidably disposed in the first channel, wherein the second elongate member is slidably disposed in the second channel.

9. The automotive lift of claim 1, further comprising a braking mechanism, wherein the braking mechanism is operable to selectively restrict movement of the first and second elongate members relative to the deck portion.

10. The automotive lift of claim 9, wherein the braking mechanism comprises:

(i) a brake ground fixedly secured relative to the deck portion, and (ii) a pawl configured to selectively engage the brake ground to selectively restrict movement of the first and second elongate members relative to the deck portion.

11. The automotive lift of claim 10, wherein the brake ground comprises a plurality of slots configured to receive a portion of the pawl.

12. The automotive lift of claim 11, wherein the brake ground has a length, wherein the slots are positioned along a portion of the length of the brake ground, wherein the slots are spaced progressively further apart from each other along the portion of the length of the brake ground.

13. The automotive lift of claim 10, wherein the pawl is resiliently biased to engage the brake ground, the braking mechanism further comprising a pneumatic cylinder assembly operable to selectively disengage the pawl from the brake ground.

14. The automotive lift of claim 1, wherein the hydraulic system comprises:

(i) a first cylinder assembly associated with the first runway section, (ii) a second cylinder assembly associated with the second runway section, and (iii) a pump in fluid communication with the first and second cylinder assemblies.

15. The automotive lift of claim 14, wherein the hydraulic system further comprises:

(i) a first proportional valve positioned between the pump and the first cylinder assembly, wherein the first proportional valve is selectively adjustable to provide a plurality of flow rates between a fully opened flow rate and a zero flow rate, and (ii) a second proportional valve assembly positioned between the pump and the second cylinder assembly, wherein the second proportional valve is selectively adjustable to provide a plurality of flow rates between a fully opened flow rate and a zero flow rate.

16. The automotive lift of claim 15, further comprising:

(a) a first position sensor coupled with the first runway section, wherein the first position sensor is configured to sense the height of the first runway section relative to the ground;

(b) a second position sensor coupled with the second runway section, wherein the second position sensor is configured to sense the height of the second runway section relative to the ground; and (c) a controller in communication with the first and second position sensors, wherein the controller is configured to compare height data from the first and second position sensors to detect disparities between the height of the first runway section relative to the ground and the height of the second runway section relative to the ground, wherein the controller is further configured to selectively adjust one or both of the first or second proportional valve assemblies in response to disparities detected during ascent or descent of the runway sections.

17. The automotive lift of claim 1, further comprising a pair of link arms, wherein the link arms are pivotally secured relative to the first pair of legs, wherein the link arms are further pivotally secured relative to the deck portion.

18. The automotive lift of claim 1, wherein the second runway section comprises:

(i) a deck portion, (ii) a third pair of legs, wherein the third pair of legs comprises a fifth leg and a sixth leg, (iii) a fourth pair of legs, wherein the fourth pair of legs comprises a seventh leg and an eighth leg, (iv) a third elongate member pivotally coupled with the fifth and seventh legs, and (v) a fourth elongate member pivotally coupled with the sixth and eighth legs, wherein the third and fourth elongate members are slidable relative to the deck portion of the second runway section.

19. An automotive lift, comprising:

(a) a runway section, wherein the runway section comprises:

(i) a deck portion, (ii) a first pair of legs, wherein the first pair of legs comprises a first leg and a second leg, (iii) a second pair of legs, wherein the second pair of legs comprises a third leg and a fourth leg, (iv) a first elongate member pivotally coupled with the first and third legs, and (v) a second elongate member pivotally coupled with the second and fourth legs, wherein the first and second elongate members are slidable relative to the deck portion, wherein the runway section is configured to raise and lower relative to the ground; and (b) a cylinder assembly, wherein the cylinder assembly comprises:

(i) a cylinder having a first end and a second end, wherein the first end of the cylinder is closed, wherein the first end of the cylinder is coupled with the deck portion of the runway section and is oriented parallel to the deck s portion of the runway section, (ii) a piston slidably extending from the second end of the cylinder, wherein the piston is oriented parallel to the deck portion of the runway section, and (iii) a piston coupling member coupled with the piston, wherein the piston coupling member is further coupled with the first and second elongate members, such that the cylinder assembly is operable to translate the first and second elongate members relative to the deck portion.

20. An automotive lift, comprising:

(a) a runway section, wherein the runway section comprises:

(i) a deck portion, wherein the deck portion has an underside, (ii) a first pair of legs, wherein the first pair of legs comprises a first leg and a second leg, (iii) a second pair of legs, wherein the second pair of legs comprises a third leg and a fourth leg, (iv) a first elongate member pivotally coupled with the first and third legs, and (v) a second elongate member pivotally coupled with the second and fourth legs, wherein the first and second elongate members are slidable relative to the deck portion, wherein the runway section is configured to raise and lower relative to the ground; and (b) a braking mechanism, wherein the braking mechanism comprises (i) a brake ground extending along the underside of the deck portion, wherein the brake ground is fixedly secured to the underside of the deck portion and extends along the underside of the deck portion, (ii) a pawl configured to selectively engage the brake ground, and (iii) a pawl actuator operable to selectively disengage the pawl from the brake ground.

* * * * *